United States Patent [19]

Bahr et al.

[11] Patent Number: 4,676,769

[45] Date of Patent: Jun. 30, 1987

[54] METHOD AND APPARATUS FOR REGULATING THE RESISTANCE OF FILTER ROD SECTIONS TO THE FLOW OF GASES THERETHROUGH

[75] Inventors: Thomas Bahr, Waiblingen/Hohenacker; Peter Michel, Glinde, both of Fed. Rep. of Germany

[73] Assignee: Hauni-Werke Körber & Co. KG, Hamburg, Fed. Rep. of Germany

[21] Appl. No.: 794,098

[22] Filed: Nov. 1, 1985

[30] Foreign Application Priority Data

Nov. 10, 1984 [DE] Fed. Rep. of Germany ..... 3441189

[51] Int. Cl.[4] ..... B31C 13/00

[52] U.S. Cl. ..... 493/4; 156/361; 493/42; 493/44; 493/48

[58] Field of Search ..... 493/4, 24, 29, 30, 34, 493/42, 44, 48; 156/356, 360, 361, 441, 180; 28/255, 273, 283

[56] References Cited

U.S. PATENT DOCUMENTS

| | | | |
|---|---|---|---|
| 3,016,945 | 1/1962 | Wexler | 156/441 |
| 3,262,181 | 7/1966 | Hawkins et al. | 28/283 |
| 3,323,961 | 6/1967 | Gallagher | 156/441 |
| 3,703,754 | 11/1972 | Blanc et al. | 28/255 |
| 3,971,695 | 7/1976 | Block | 156/180 |
| 4,248,139 | 2/1981 | Labbe | 493/42 |

*Primary Examiner*—Frederick R. Schmidt
*Assistant Examiner*—Robert Showalter
*Attorney, Agent, or Firm*—Peter K. Kontler

[57] ABSTRACT

The pressure of compressed air in one or more nozzles which convert successive increments of a running tow of filamentary filter material into a rodlike filler in a filter rod making machine is regulated in response to variations in the speed of the filler. This ensures that the resistance which the filter rod sections offer the flow of tobacco smoke does not deviate from an optimum value when the speed of the filler is reduced below the nominal speed. The pressure of air which is admitted to the nozzle or nozzles is regulated by a variable-speed blower which compresses air preparatory to admission into the nozzle or nozzles, or by installing in the conduit or conduits for one or more nozzles a pressure regulating valve which is adjusted by a servomotor in response to signals denoting the speed of the filler.

9 Claims, 3 Drawing Figures

METHOD AND APPARATUS FOR REGULATING THE RESISTANCE OF FILTER ROD SECTIONS TO THE FLOW OF GASES THERETHROUGH

BACKGROUND OF THE INVENTION

The present invention relates to improvements in methods and apparatus for treating tows of filamentary filter material, especially for converting tows of filamentary filter material into fillers of filter rods which are thereupon subdivided into sections of unit length or multiple unit length for assembly with plain cigarettes, cigars or cigarillos into filter tipped smokers' products.

Commonly owned U.S. Pat. No. 3,971,695 to Block discloses a method of converting a tow of pretreated filamentary filter material into a continuous rod-like filler which is thereupon draped into a web of cigarette paper or other suitable wrapping material to form therewith a continuous filter rod which is ready to be subdivided into sections of desired length preparatory to admission of such sections into a reservoir for curing of the plasticizer which is applied to the filaments or directly into a filter tipping or other processing machine.

At the present time, the conversion of a tow into a rod-like filler normally takes place in a nozzle (also called aspirating jet) through which the tow is caused to advance to be thereby subjected to the action of compressed air with attendant densification ahead of the wrapping station. A suitable nozzle is disclosed in U.S. Pat. No. 3,016,945 to Wexler. It is customary to regulate the mass of filter material in the filler in order to ensure that the density of each of a long series of successively formed filter rod sections will be the same. The weight and density of filter material in the filler are regulated by varying the pressure of compressed air which is supplied to the aspirating jet or nozzle. Such regulation of the pressure of air which is admitted into the nozzle is intended to ensure that the weight of each filter rod section will match a preselected optimum value even if the weight of individual filaments deviates from an optimum weight. In many presently known filter rod making machines, the means for monitoring the weight and hence the density of successive unit lengths of the filler downstream of the nozzle comprises a density measuring device of the type known as NSR which employs a source of corpuscular radiation and is manufactured and sold by the assignee of the present application. It is also possible to employ a suitable weighing device or an X-ray machine. All that counts is to ensure that the density of filter material in successively formed filter rod sections will match, or will not deviate appreciably from, a preselected optimum value.

It has been found that, when a filter rod making machine is operated at less than nominal speed, the resistance of the fillers of filter rod sections to the flow of a gaseous fluid therethrough fluctuates within a very wide range. In other words, the so-called standard deviation or mean square deviation of such resistance is much more pronounced than when the filter rod sections are produced while the machine operates at the rated speed. Such pronounced fluctuations of standard deviation are surprising since the resistance of a filter rod section to the flow of a gaseous fluid therethrough is a function of the density of the filler, i.e., of the mass of filamentary material which fills the tubular wrapper of the filter rod section. The mass is constant irrespective of the speed of the filter rod, i.e., regardless of the selected operating speed of the filter rod making machine.

OBJECTS AND SUMMARY OF THE INVENTION

An object of the invention is to provide a novel and improved method which ensures that standard deviations of the resistance of filter rod sections to the flow of a gaseous fluid through their fillers will be maintained within acceptable limits even if the speed of the filter rod making machine, and hence of the filler of the filter rod, deviates from the normal operating speed.

Another object of the invention is to provide a method of making filter rod sections whose characteristics (particularly their resistance to the flow of a gaseous fluid therethrough) are not affected by changes in the speed of transport of the rod-like filler of filamentary filter material downstream of the station where the tow is converted into the filler.

A further object of the invention is to provide a method of reliably and immediately compensating for deviations of the so-called draw resistance of filter rod sections from an optimum resistance as soon as such deviations tend to develop.

An additional object of the invention is to provide a novel and improved apparatus for the practice of the above outlined method and to construct and assemble the apparatus in such a way that the draw resistance of filter rod sections does not deviate from an optimum value in response to decreasing speed of the filter rod.

Still another object of the invention is to provide the apparatus with novel and improved means for influencing the operation of means which are utilized to convert a continuous tow or filamentary filter material into a rod-like filler.

A further object of the invention is to provide the apparatus with novel and improved means for regulating the characteristics of compressed air which is supplied to the nozzle or nozzles of the converting means.

One feature of the invention resides in the provision of a method of treating a tow of filaments which are to constitute the filler of a filter rod. The method comprises the steps of conveying the tow along a predetermined path, subjecting successive increments of the tow to the pressure of compressed air in at least one predetermined portion of the path to densify and convert the tow into a rod-like filler, advancing the filler at a varying speed, monitoring the speed of the filler, and regulating the pressure of compressed air in the predetermined portion of the path as a function of variations of the speed of the filler.

The regulating step includes reducing the pressure of compressed air when the speed of the filler decreases and increasing the pressure of compressed air when the speed of the filler increases.

The step of subjecting successive increments of the tow to the pressure of compressed air can include subjecting successive increments of the tow to the action of compressed air in several successive portions of the path, and the regulating step then comprises regulating the pressure of compressed air in one or more or all portions of the path.

Another feature of the invention resides in the provision of an apparatus for treating a tow of filamentary filter material which is to be converted into a rod-like filler preparatory to draping into a web of cigarette paper, imitation cork or the like. The apparatus comprises means for conveying the tow along a predetermined path, means for converting the tow into a rod-like filler including at least one nozzle which surrounds a portion of the path and means for supplying to the nozzle compressed air which densifies successive increments of the tow, means for advancing the filler at a variable speed, means (e.g., a tachometer generator) for monitoring the speed of the filler and for generating signals whose intensity and/or other characteristics are indicative of the monitored speed of the filler, and means for regulating the pressure of air in the supplying means in response to signals from the monitoring means, i.e., as a function of variations of speed of the filler.

The regulating means can comprise a blower having a rotor and an outlet which admits compressed air into the supplying means, and means for varying the speed of the rotor (and hence the pressure of air which is admitted into the supplying means) in response to signals from the monitoring means.

Alternatively, or in addition to the just outlined regulating means, the regulating means can comprise a source of compressed air (e.g., a blower) which is connected to the supplying means, an adjustable pressure regulating valve (e.g., a slide valve or a butterfly valve) in the supplying means, and means for adjusting the valve in response to signals from the monitoring means. The adjusting means can comprise a servomotor.

The converting means can comprise a plurality of nozzles which surround successive portions of the path for the tow, and the supplying means then preferably comprises a discrete device (e.g., a conduit) for supplying compressed air to each of the nozzles. The regulating means of such apparatus can comprise means for regulating the pressure of air in at least one of the air supplying devices. Such regulating means can comprise an adjustable pressure regulating valve or a blower with a variable-speed rotor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
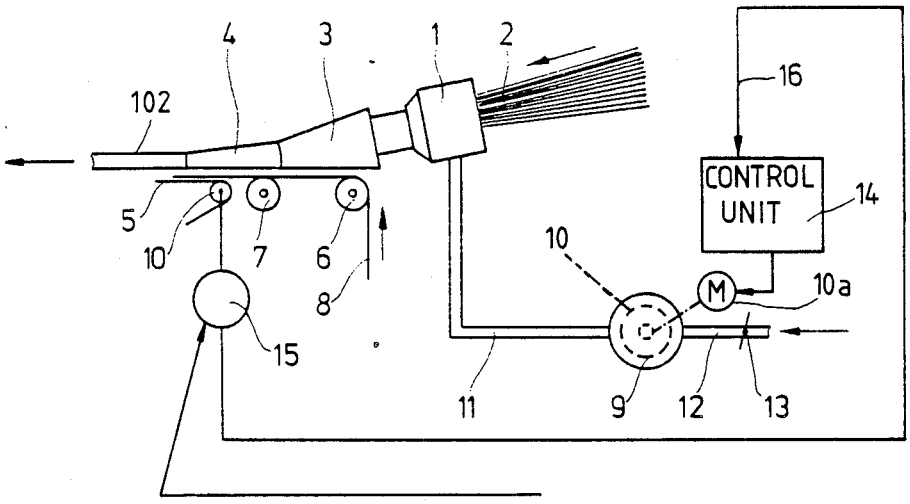
FIG. 1 is a schematic elevational view of an apparatus which embodies one form of the invention and wherein the regulating means comprises a blower with a variable-speed rotor.

FIG. 1 shows a portion of an apparatus which is incorporated in a filter rod making machine and includes means for conveying a continuous tow 2 of filamentary filter material along a predetermined path from a suitable source, e.g., from a bale of the type shown in the aforementioned patent to Block whose disclosure is incorporated herein by reference. Block also shows the conveying means which advances the tow to a forming means, e.g., a gathering horn 3 upstream of a tongue 4. The latter is located upstream of a draping mechanism which can be of the type disclosed by Block. The reference character 1 denotes a nozzle or aspirating jet which can be of the type disclosed by Wexler whose disclosure is also incorporated herein by reference. The nozzle 1 is supplied with compressed air by a conduit 11 and the flow of compressed air which acts upon successive increments of the tow 2 in the interior of the nozzle converts the tow into a rod-like filler 102. The ultimate density and shape of the filler 102 are determined by the horn 3, tongue 4 and the aforementioned wrapping mechanism. The wrapping mechanism receives a continuous web 8 of cigarette paper, imitation cork or other suitable wrapping material from a reel (see the disclosure of Wexler), and such web is trained over rollers 6 and 7 on its way toward the upper reach of an endless belt conveyor 5 serving as a means for advancing the rod-like filler 102 in a direction to the left, as viewed in FIG. 1. The belt conveyor 5 is trained over several pulleys including a pulley 10 whose RPM is monitored by a tachometer generator 15 which generates signals denoting the speed of the filler 102 and of the web 8 which overlies the upper reach of the conveyor 5. The reference character 16 denotes a conductor which transmits signals from the tachometer generator 15 to the input of a control unit 14 whose output transmits signals to the motor of a blower 9 having an outlet which admits compressed air into the air supplying conduit 11 and hence to the nozzle 1. The inlet of the blower 9 draws atmospheric air by way of a conduit 12 which can contain an adjustable flow restrictor 13, e.g., a butterfly valve. The rotor of the blower 9 is shown at 10, and such rotor is driven by a variable-speed motor 10*a* which receives signals from the output of the control unit 14.

The manner in which the pressure of compressed air in the conduit 11 is regulated in order to ensure that the density of filamentary filter material in the filler 102 will not deviate from a preselected density is known and is not shown in FIG. 1. The regulating means including the blower 9 and the control unit 14 is designed to regulate the pressure of air in the supply conduit 11 in dependency on deviations of the speed of the conveyor 5 (and hence of the filler 102) from the normal or rated value. This ensures that the resistance which the sections of the filter rod offer to the flow of a gas through their fillers does not deviate from an optimum value if the speed of the conveyor 5 is reduced below the rated speed. The rod which is obtained by draping the web 8 around the filler 102 is subdivided into sections of desired length by a suitable cutoff (see the disclosure of Block), and the sections are admitted into a reservoir (e.g., of the type known as RESY manufactured by the assignee of the present application) or directly into a filter tipping machine (such as MAX or MAX S, both manufactured by the assignee of the present application).

The control unit 14 can be of the type known as SRM (manufactured and sold by the assignee of the present application). Other types of control units can be used with equal or similar advantage.

The operation of the improved apparatus is such that the pressure of air which is admitted into the nozzle 1 is reduced when the speed of the filler 102 decreases, and that the pressure of air in the conduit 11 is increased in response to increasing speed of the conveyor 5. As mentioned above, the pressure of air which is admitted into the nozzle 1 is or can also be regulated for the purpose of ensuring that the density of all filter rod sections which are obtained in response to severing of the filter rod including the web 8 and the filler 102 will match or closely approximate an optimum density.

It has been found that the resistance which the filter rod sections offer to the flow of tobacco smoke therethrough is not affected by a reduction of the speed of the conveyor 5 if the pressure of air that enters the nozzle 1 via conduit 11 is regulated in response to signals denoting the speed of the conveyor 5 and filler 102. This is of great importance because it contributes to the quality of filter tipped smokers' products, especially of filter rod sections in output-controlled filter rod making machines.

Figure 2:
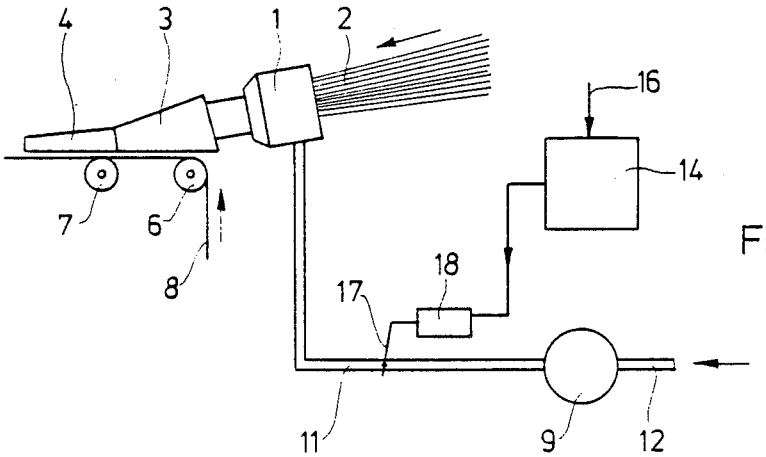
FIG. 2 is a similar schematic elevational view of a second apparatus wherein the regulating means comprises an adjustable pressure regulating valve.

FIG. 2 shows a modified apparatus wherein all such parts which are identical with or clearly analogous to the corresponding parts of the apparatus of FIG. 1 are denoted by similar characters. The means for regulating the pressure of air which is admitted into the nozzle 1 of FIG. 2 comprises a blower 9 or another suitable source of compressed air for the conduit 11, an adjustable pressure regulating valve 17 (e.g., a slide valve) which is installed in the conduit 11 downstream of the blower 9, and the aforementioned control unit 14 which receives signals denoting the speed of the conveyor for the filler issuing from the horn 3. The output of the control unit 14 transmits signals to a servomotor 18 which constitutes a means for adjusting the valve 17 in response to changes in the speed of the filler. The motor of the blower 9 may but need not be of the variable-speed type.

Figure 3:
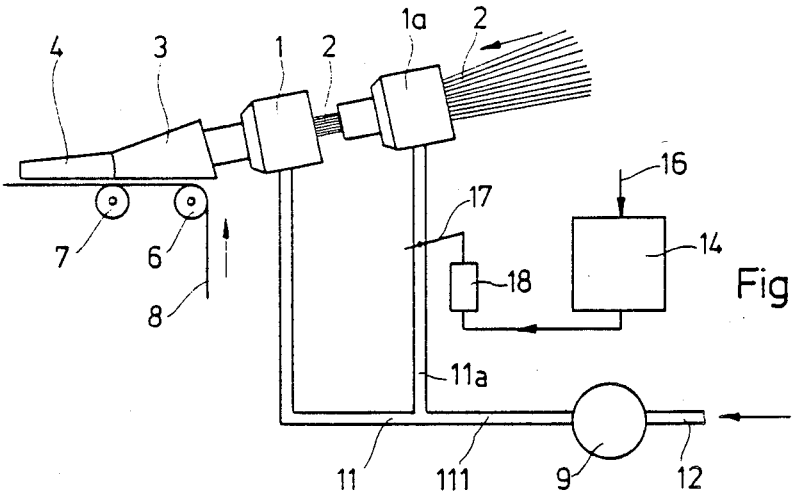
FIG. 3 is a similar schematic elevational view of a third apparatus wherein the converting means comprises two nozzles and the regulating means comprises means for varying the pressure of air which is supplied to one of the nozzles.

FIG. 3 shows a third apparatus wherein the means for converting successive increments of the tow 2 into successive increments of the rod-like filler comprises two nozzles 1 and 1*a* surrounding successive portions of the path of advancement of the filler toward and into the horn 3. The devices for supplying compressed air to the nozzles 1 and 1*a* comprises two discrete conduits 11 and 11*a* which merge into a single conduit 111 receiving compressed air from the outlet of the blower 9. The pressure of air which is admitted into the nozzle 1 is not regulated in response to changes in the speed of the filler. The conduit 11*a* contains an adjustable air pressure regulating valve 17 whose position is adjusted by a servomotor 18 in response to signals from the output of the control unit 14 whose input receives signals from the tachometer generator (not shown in FIG. 3) via conductor 16.

The apparatus of FIG. 3 can be modified by providing an additional valve 17 in the conduit 11 and by connecting such additional valve to the output of the control unit 14 by the illustrated servomotor 18 or by a discrete servomotor. Alternatively, the nozzle 1*a* can receive air at a constant pressure and the regulating means can comprise a valve in the conduit 11 for the nozzle 1. Still further, the apparatus can comprise three or more nozzles, and the regulating means can include means for varying the pressure of air which is admitted to all of the nozzles or to a single nozzle or to several (but not to all of the) nozzles.

An advantage of the apparatus which employs several nozzles is that it can operate with air whose pressure is relatively low. For example, the blower 9 of FIG. 3 can be omitted and the conduit 111 can be connected directly to a source of compressed air which is invariably available in a filter rod making machine (or in a production line including a filter rod making machine), for example, to segregate defective rod-shaped articles from satisfactory articles. Such segregating means normally comprises a nozzle which directs a jet of compressed air against an oncoming defective article in order to expel the defective article from the path wherein acceptable articles advance to the next processing station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of treating a tow of filaments, comprising the steps of conveying the tow along a predetermined path; subjecting successive increments of the tow to the pressure of compressed air introduced into at least one predetermined portion of the path to densify and convert the tow into a rod-like filler having a predetermined density; advancing the filler at a varying speed; monitoring the speed of the filler; and regulating the pressure of said compressed air introduced at said portion of said path as a function of variations of the speed of the filler.

2. The method of claim 1, wherein said regulating step includes reducing the pressure of air when the speed of the filler decreases and increasing the pressure of air when the speed of the filler increases.

3. The method of claim 1, wherein said subjecting step includes subjecting successive increments of the tow to the action of compressed air in several successive portions of said path, and said regulating step comprises regulating the pressure of air in at least one of said several successive portions of said path.

4. Apparatus for treating a tow of filamentary material, comprising means for conveying the tow along a predetermined path; means for converting the tow into a rod-like filler, including at least one nozzle surrounding a portion of said path and means for supplying to the nozzle compressed air which densifies successive increments of the tow; means for advancing the filler at a variable speed; signal generating means for monitoring the speed of the filler; and means for regulating the pressure of air in said supplying means in response to signals from said monitoring means.

5. The apparatus of claim 4, wherein said regulating means comprises a blower having a rotor and an outlet connected to said supplying means, and means for varying the speed of said rotor in response to signals from said monitoring means.

6. The apparatus of claim 4, wherein said regulating means comprises a source of compressed air connected to said supplying means, an adjustable pressure regulating valve in said supplying means, and means for adjusting said valve in response to signals from said monitoring means.

7. The apparatus of claim 6, wherein said adjusting means comprises a servomotor.

8. The apparatus of claim 4, wherein said converting means comprises a plurality of nozzles surrounding successive portions of said path and said supplying means comprises a discrete device for supplying compressed air to each of said nozzles, said regulating means comprising means for regulating the pressure of air in at least one of said devices.

9. The apparatus of claim 8, wherein said regulating means comprises an adjustable valve in said one device.

* * * * *